US005152243A

United States Patent [19]

Kuan

[11] Patent Number: 5,152,243

[45] Date of Patent: Oct. 6, 1992

[54] STRUCTURE OF INFLATABLE BOAT

[75] Inventor: Frank C. Kuan, Taipei, Taiwan

[73] Assignee: Yung Hsin Plastics Corporation, Taipei, Taiwan

[21] Appl. No.: 748,551

[22] Filed: Aug. 22, 1991

[51] Int. Cl.[5] ..... B63B 7/08

[52] U.S. Cl. ..... 114/345

[58] Field of Search ..... 114/345, 347; 441/40, 441/38, 129

[56] References Cited

U.S. PATENT DOCUMENTS

| | | | |
|---|---|---|---|
| 2,999,253 | 9/1961 | Lewis | 114/345 X |
| 3,168,751 | 2/1965 | Cavaignac et al. | 114/345 |
| 3,659,298 | 5/1972 | Edwards | 114/345 |
| 4,723,502 | 2/1988 | Sayama | 441/40 |

FOREIGN PATENT DOCUMENTS

| | | | |
|---|---|---|---|
| 13114 | 7/1980 | European Pat. Off. | 114/345 |

*Primary Examiner*—Sherman Basinger

*Attorney, Agent, or Firm*—Fleit, Jacobson, Cohn, Price, Holman & Stern

[57] ABSTRACT

An inflatable boat comprising a unitary bottom which is comprised of a plurality of parallel, elongated air chambers and has two opposite ends curving upwards respectively, two bulwarks separately attached to the bottom at two opposite sides through a welding joint, two hood-like connecting members connected between the two bulwarks and the bottom at two opposite ends. Parallel grooves are formed in the bottom between the elongated air chambers for guiding waves so as to reduce resisting force during sailing.

2 Claims, 3 Drawing Sheets

STRUCTURE OF INFLATABLE BOAT

BACKGROUND OF THE INVENTION

The present invention relates to an inflatable boat, the bulwarks of which are separately attached to the bottom thereof at two opposite sides through welding joint and joined by two hoop-like connecting members at two opposite ends and, the bottom of which is comprised of a plurality of parallel air chambers each having two opposite ends curving upwards for guiding waves.

FIG. 4 illustrates an inflatable boat constructed according to the prior art which is generally comprised of a bottom and a unitary, endless peripheral wall raising around the periphery of said bottom. In this structure of inflatable boat, the peripheral wall occupies much space on the stern of the boat. While moving on the surface of the sea, rivers, lakes, great water resisting force is caused at the peripheral wall of the boat. Further, this structure of inflatable boat does not have any means to guide out waves for stable sailing.

SUMMARY OF THE INVENTION

The present invention has been accomplished to eliminate the aforesaid disadvantages. It is therefore an object of the present invention to provide an inflatable boat which has means to reduce water resisting force and guide out waves during sailing. It is another object of the present invention to provide an inflatable boat which provides much available space.

According to the present invention, there is provided an inflatable boat which is generally comprised of a bottom which is comprised of a plurality of parallel, elongated air chambers each of which having two opposite ends curving upwards, two bulwarks separately attached to said bottom at two opposite sides through welding joint, and two hood-like connecting members connected between said two bulwarks and said bottom at two opposite ends. Because the two bulwarks are not directly connected together, much available space at the bow and the stern of the boat can be used. Because the two opposite ends of the bottom respectively curve upwards and a plurality of grooves are formed between the parallel, elongated air chambers of the bottom, water resisting force is reduced and water waves are guided away during sail.

DETAILED DESCRIPTION OF THE PREFERRED EMBODIMENT

Figure 1:
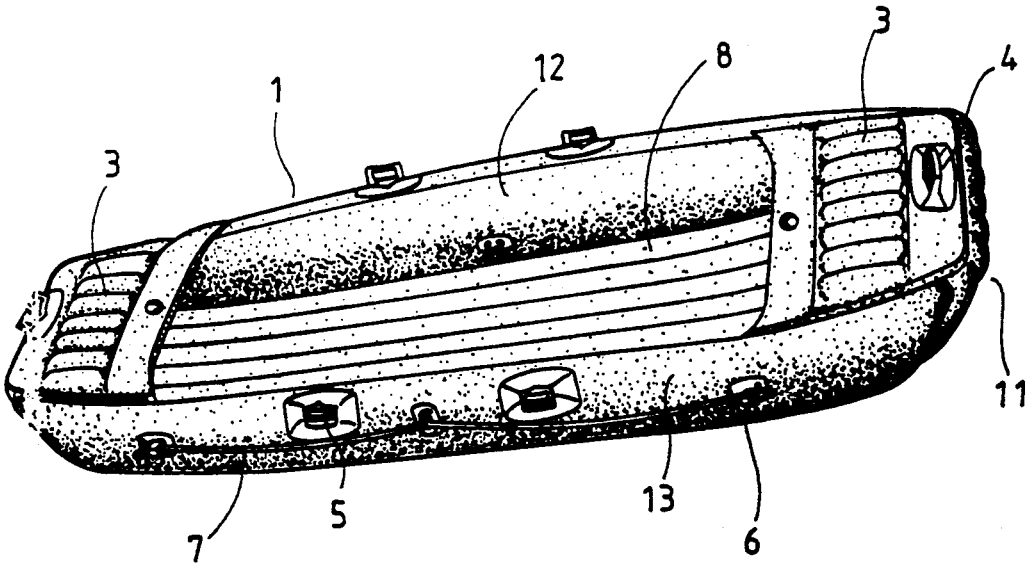
FIG. 1 is a perspective view of the preferred embodiment of the inflatable boat of the present invention.
Figure 2:
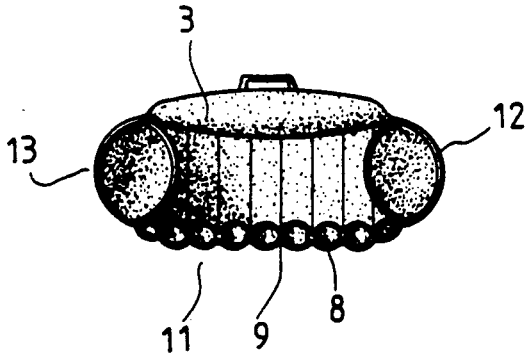
FIG. 2 is a cross sectional view thereof taken in transverse direction.
Figure 3:
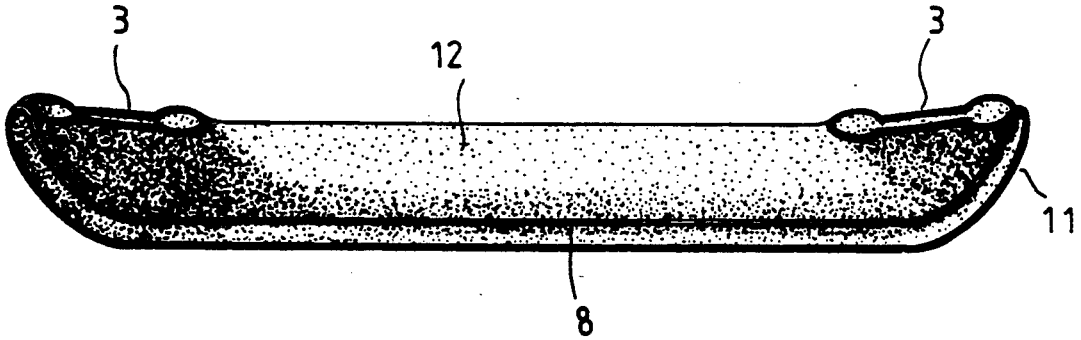
FIG. 3 is a cross sectional view thereof taken in longitudinal directional.
Figure 4:
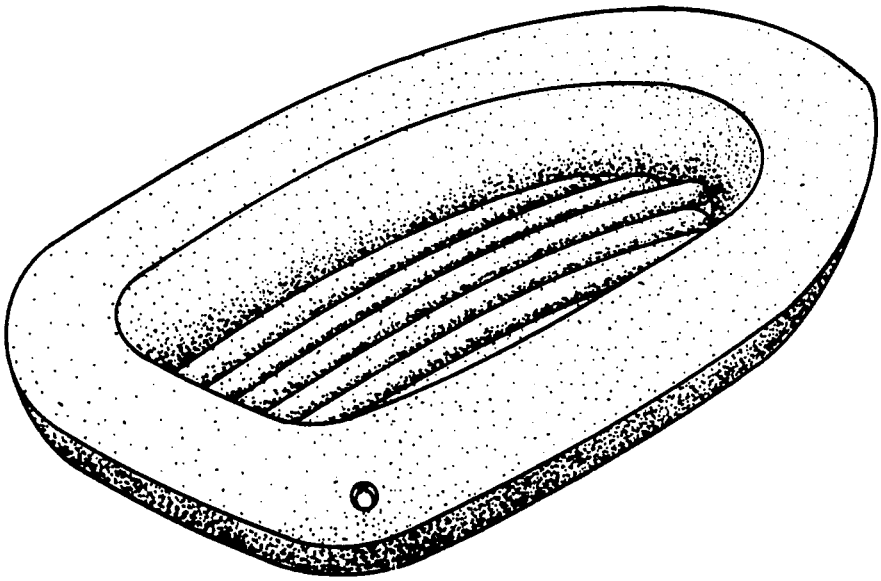
FIG. 4 PRIOR ART
FIG. 4 is a perspective view of an inflatable board according to the prior art.

Referring to FIGS. 1, 2 and 3, therein illustrated is an inflatable boat constructed in accordance with the present invention which is generally comprised of a unitary bottom 11 having two separate bulwarks 12, 13 attached thereto at two opposite sides through welding joint and two hood-like connecting members 3 at two opposite ends to connect said bottom 11 and said two separate bulwarks 12, 13 together. By means of said arrangement, an inflatable boat body 1 is formed. Cushions, hand-holds 4, supporting rings 5, rope binding rings 6, rope 7 and other accessories may be installed in the boat according to requirements.

The bottom 11 of the inflatable boat body 1 is integrally made through the process of injection molding and comprised of a plurality of parallel, elongated, cylindrical air chambers 8 with a plurality of straight grooves 9 defined therebetween, wherein said air chambers 8 each has two opposite ends curving upwards. While moving along the surface of the sea, river or lake, the upwards curved bow and stern of the boat body 1 and the grooves 9 on the bottom 11 thereof enable the inflatable boat body 1 to float on the surface of the sea, river or lake and simultaneously guide waves downwards backwards. Therefore, less resisting force is applied at the inflatable boat body 1 during its sailing and the inflatable boat body 1 can move on the sea, river or lake more stably and quickly. Further, because the two bulwarks 12, 13 are not directly connected together, more available space is provided inside the inflatable boat body 1 for use.

What is claimed is:

1. An inflatable boat comprising a unitary bottom having two bulwarks separately attached thereto at two opposite sides through a welding joint, and characterized in that said bottom is comprised of a plurality of parallel, elongated air chambers having opposite ends respectively curving upwards to form the bow and stern of the boat and hood-like members connected between the bulwarks and the bow and stern respectively.

2. A boat as claimed in 1 wherein the hood-like members are connected between upper margins of the bulwarks and the bow and stern respectively to define spaces between said members and the bottom of the boat.

* * * * *